US005195579A

United States Patent [19]

Buchanan

[11] Patent Number: 5,195,579

[45] Date of Patent: Mar. 23, 1993

[54] INTEGRAL TAB LOCK AND BRACKET ASSEMBLY FOR HEADERED TUBE CONDENSER

[75] Inventor: William J. Buchanan, Olcott, N.Y.

[73] Assignee: General Motors Corporation, Detroit, Mich.

[21] Appl. No.: 916,456

[22] Filed: Jul. 20, 1992

[51] Int. Cl.[5] ..... F28D 1/053; F28F 9/02

[52] U.S. Cl. ..... 165/149; 165/173; 29/890.052

[58] Field of Search ..... 165/173, 149, 153; 29/890.052

[56] References Cited

U.S. PATENT DOCUMENTS

| | | | |
|---|---|---|---|
| 2,539,701 | 1/1951 | Przyborowski | 165/149 |
| 4,351,390 | 9/1982 | Argyle et al. | 165/149 |
| 4,546,823 | 10/1985 | Melnyk | 165/149 |
| 4,649,628 | 3/1987 | Allemandou | 165/173 |
| 4,651,815 | 3/1987 | Logic et al. | 165/173 |
| 4,738,308 | 4/1988 | Moranne | 165/149 |
| 4,917,180 | 4/1990 | Wolf et al. | 165/175 |
| 4,971,145 | 11/1990 | Lyon | 165/173 |

FOREIGN PATENT DOCUMENTS

| | | | |
|---|---|---|---|
| 3222278 | 12/1983 | Fed. Rep. of Germany | 165/149 |
| 3222300 | 12/1983 | Fed. Rep. of Germany | 165/173 |
| 86395 | 5/1983 | Japan | 165/173 |
| 840451 | 7/1960 | United Kingdom | 165/175 |

*Primary Examiner*—John Rivell
*Assistant Examiner*—L. R. Leo
*Attorney, Agent, or Firm*—Patrick M. Griffin

[57] ABSTRACT

A locking heat exchanger apparatus includes a pair of longitudinal tank units each establishing a fluid chamber therein and formed of separate headers and tanks. A core comprising parallel tube passes and air centers therebetween is connected between the tank units in fluid communication with the fluid chambers. The headers and tanks include flanges extending about the periphery thereof having notches therein. A locking bar includes cross arms received within the notches and interconnecting to longitudinal, parallel bars which abut the flanges of the tank and header for locking the tank with the header for brazing thereof.

2 Claims, 3 Drawing Sheets

INTEGRAL TAB LOCK AND BRACKET ASSEMBLY FOR HEADERED TUBE CONDENSER

TECHNICAL FIELD

The invention relates to heat exchangers of the type having a pair of tank units comprising separate headers and tanks with parallel flow passes and air centers extending therebetween, and more particularly to the locking of the headers to the tanks for brazing thereof.

BACKGROUND OF THE INVENTION

Heat exchangers used in motor vehicle air conditioning systems condensers commonly have a plurality of parallel flat sided extruded tubes connected at opposite ends to a pair of headered tanks, and air centers connected between the tubes to facilitate efficient heat transfer to the surrounding area. The headered tanks generally comprise a separate header with slots therethrough for receiving the extruded tubes, and a tank secured to the header to supply refrigerant and receive the same from the tubes. The air centers are brazed to the sides of adjacent tubes, and the tubes are brazed or otherwise bonded to the header along with the tanks to assure leak free joints.

During assembly, the header and tanks must be secured to one another so that brazing can seal the joints therebetween. It has been known to align and fasten the tanks to the header by use of self-contained, preformed tabs spaced at intervals about the periphery of the header or tank as disclosed in U.S. Pat. No. 4,971,145, issued Nov. 20, 1990 in the name of Lyon and issued to the assignee of the subject invention. The preformed tabs are clinched over the adjoining part to provide proper alignment between the mating tank and header, and also provide appropriate contact pressure to facilitate the joining or brazing process. This tab assembly method increases the depth of the tank to header joint geometry since additional space is required to accommodate for the integral clinched tabs. The dimension penalty can cause space packaging problems in certain vehicle applications. In addition, providing the self-contained tabs also requires considerable additional raw material size for the tab containing components.

U.S. Pat. No. 4,738,308, issued Apr. 19, 1988 in the name of Moranne discloses a mechanical assembled heat exchanger of similar type described above. The heat exchanger forms the headers to the tanks by providing side flanges connected at either end of the tank units to clamp the ends of the header plate to the tank, in conjunction with spacers or side plates which are connected between the tank units.

SUMMARY OF THE INVENTION

The invention relates to a locking heat exchanger apparatus of the type having a pair of longitudinal tank units each formed by separate headers and tanks and which support a core therebetween. Each tank unit provides a fluid chamber formed by a separate header and tank. The core has a plurality of parallel flow tube passes extending between the tank units and includes air centers connected between the tube passes. Each of the headers and tanks include longitudinal flanges extending longitudinally along the sides thereof for providing complimentary abutting surfaces therealong to seal the tank unit during brazing. The tanks and headers provide a tank width established between the flanges across the fluid chamber. The improvement includes locking means for securement against the longitudinal flanges within the tank width to maintain the header against the tank.

The invention also includes longitudinal flanges of the header and tank that have notches formed therein. The locking means extends within the notches of the flanges for securing the header against the tank to better facilitate brazing therebetween.

The invention also includes the locking means comprising a longitudinally extending first bar having integral cross arms extending therefrom perpendicular with the first bar and spaced along the first bar and received within the notches. A second parallel bar is integral with the cross arms and perpendicular therewith for abutting against the opposing flange to lock the flanges of the header and tank to one another.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
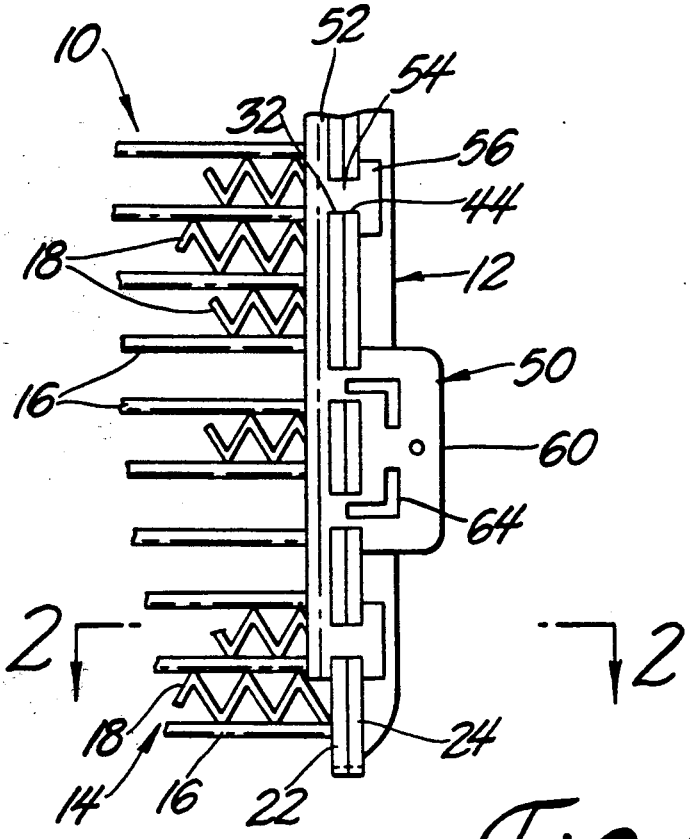
FIG. 1 a partial front view of a heat exchanger utilizing the subject invention.

A locking heat exchanger apparatus is generally shown at 10 in FIG. 1. In the preferred embodiment, heat exchanger is generally a condenser of the type utilized in motor vehicle air conditioning systems. While the ensuing description is directed toward a condenser for motor vehicle air conditioning system, the invention clearly applies to other heat exchangers and applications as well.

The heat exchanger 10 comprises a pair of tank units 12, only one of which is shown. The tank units 12 support a core 14 therebetween. The core 14 comprises a plurality of flat sided extruded tubes 16 arranged in parallel relationship for providing parallel flow tube passes. Air centers 18 of sinusoidal configurations are arranged between the extruded tubes 16 for thermal coupling of the tubes with ambient air. The ends of the extruded tubes 16 are connected to the tank units 12 to provide fluid communication across the condenser. The extruded tubes 16 are in fluid communication with a fluid chamber 20 formed within the tank units 12. The chamber 20 contains the refrigerant used in the condensers 10.

Figure 2:
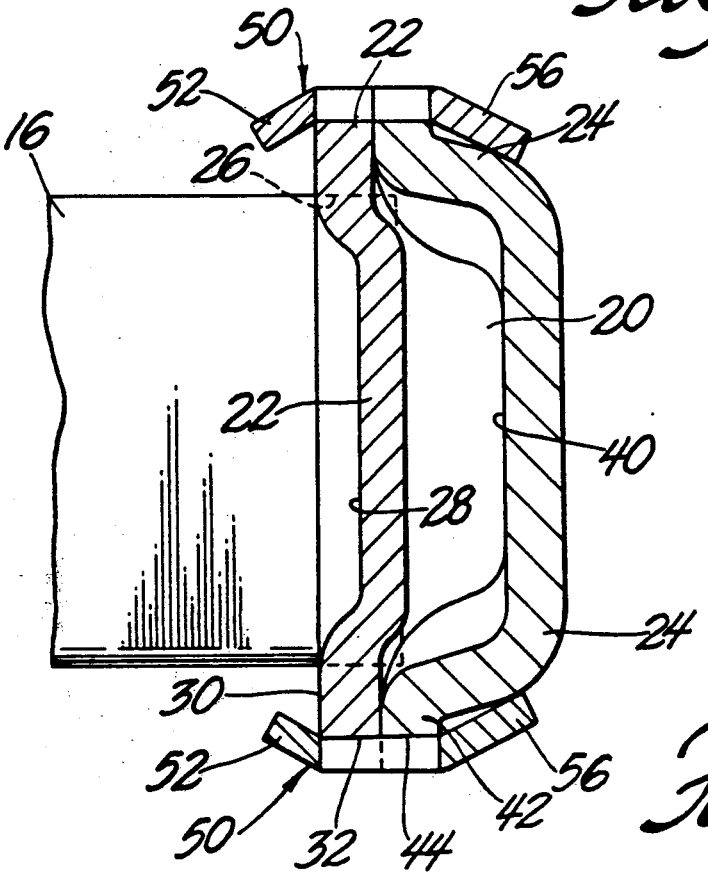
FIG. 2 is an enlarged cross sectional view taken along lines 2—2 of FIG. 1.
Figure 3:
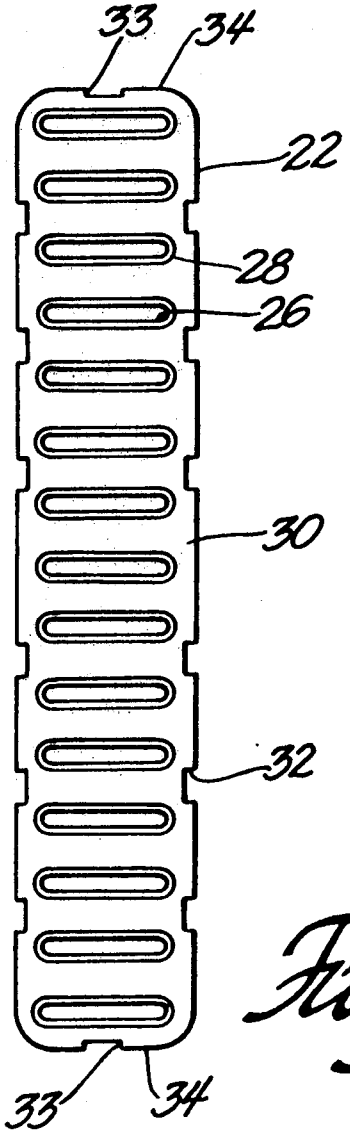
FIG. 3 is a front elevational view of the header of the subject invention.

The tank units 12 are formed by separate headers 22 and tanks 24. The header 22 includes a plurality of tube slots 26 therethrough for receiving the ends of the extruded tubes 16. The header 22 is best shown in FIGS. 2 and 3. The header 22 include a plurality of indentations 28 formed at the tube slots 26. The sides or perimeter of the header 22 is formed by a continuous flat flange 30 with the slots 26 and indentation 28 formed between each longitudinal side of the flange 30. The sides of flange 30 of the header 22 include a plurality of notches 32 therein, the function of which will be subsequently discussed. In the preferred embodiment, the header 22 includes fifteen tube slots 26, and six notches 32 extending on each longitudinal side of flange 30 and with an end slot 33 in each end 34 of flange 30 of the header 22.

Figure 4:
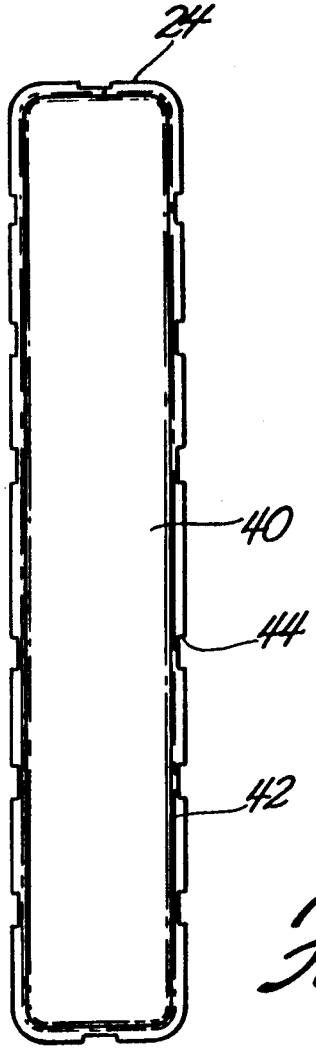
FIG. 4 is a front elevational view of the tank of the subject invention.

The tank 24 is best illustrated in FIGS. 2 and 4. The tank 24 provides a recessed chamber 40 for allowing the flow of fluid therein. The recessed chamber 40 is surrounded by a flat tank flange 42 providing a complimentary flat surface for mating or abutting with the header flange 30. The tank flange 42 also includes a plurality of notches 44 extending therein about the perimeter of the tank 24. When the header 22 and tank 24 are assembled, the flanges 30, 42 abut and mate with the notches 32 and 44 aligned with one another. Therefore, the number of notches 44 on the tank 24 is identical to the notches 32 provided on the header 22. A tank width is established by and between the outer edges of the flanges 30, 42 across the fluid chamber 40.

Though not shown, it is to be understood that the tank 24 includes two apertures thereon for providing the inlet and outlet connection of refrigerant to the heat exchanger. The connection of the inlet and outlet tubes to the heat exchanger is commonly known in the art as described in U.S. Pat. No. 4,971,145 set forth in the Background and incorporated by reference herein.

The apparatus 10 includes locking means 50 for securing the header 22 against the tank 24 at the longitudinal flanges 30, 42. The locking means 50 extends within the tank width of the header 22 and tank 24 to prevent added dimension by extension of the locking means 50 beyond the tank width. The locking means 50 provides for two embodiments thereof having related configurations. Similarities will first be discussed, with differences between the embodiments discussed thereafter.

The locking means 50 extends within the notches 32, 44 of the header 22 and tank 24, respectively. The locking means 50 comprises a longitudinally extending first bar 52 having a plurality of cross arms 54 extending perpendicular therefrom and spaced along the first bar 52. The cross arms 54 are received within the notches 32, 44. A second bar 56 is connected to the cross arms 54 spaced from and parallel to the first bar 52. The first bar 52 and second bar 56 abut against the flanges 30, 42 to effectively sandwich the flanges 30, 42 between the two bars 52, 56 with the cross arm 54 extending within the notches 32, 44. The first bar 52 abuts against the flange 30 of the header 22 and the second bar 56 abuts against the flange 42 of the tank 24. A gap 57 provided between the two bars 52, 56 is approximately equivalent to the combined thickness of the flanges 30, 42 of the header 22 and tank 24. The thickness of the bars 52, 56 and arms 54 are equivalent to the depth of the notches 32, 44 to therefore prevent extension of the locking means 50 beyond the original tank width of the headers 22 and tank 24. The bars 52, 56 and arms 54 are an integral stamping.

Figure 7:
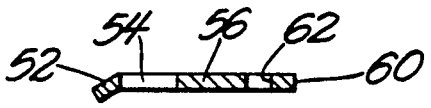
FIG. 7 is an enlarged cross sectional view taken along line 7—7 of FIG. 5.
Figure 5:
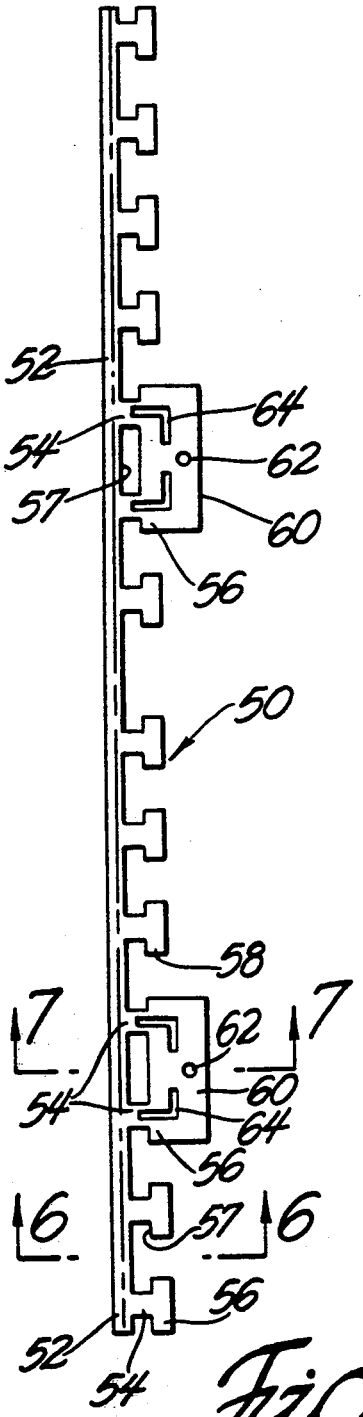
FIG. 5 is an elevational side view of the locking means of a first embodiment of the subject invention.
Figure 8:
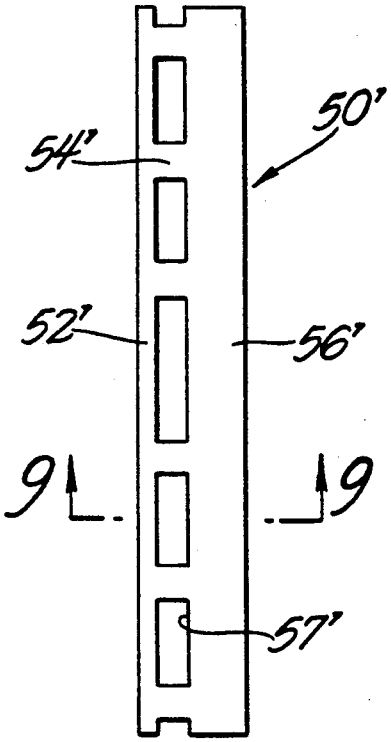
FIG. 8 is an elevational side view of a second embodiment of the locking means.
Figure 9:
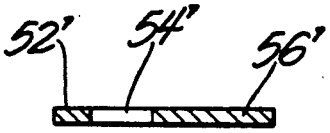
FIG. 9 is an enlarged cross sectional view taken along lines 9—9 of FIG. 8.
Figure 6:
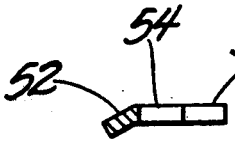
FIG. 6 is an enlarged cross sectional view taken along line 6—6 of FIG. 5.

The first embodiment of the locking means 50 is illustrated in FIGS. 5-7, and the second embodiment is illustrated in FIGS. 8-9. Primed numerals indicate similar parts in each embodiment.

In the first embodiment of FIG. 5-7, the second bar 56 is discontinuous. In other words, a separate bar 56 is connected to each cross arm 54 perpendicular therewith and parallel with the first bar 52 providing locking flanges 58 extending beyond the width of the cross arms 54. Periodically, the bar 56 includes interconnecting portions 60 wherein two cross arms 54 or bars 56 are interconnected by an enlarged plate 60. In the preferred embodiment, two enlarged portions 60 are provided as illustrated. The enlarged portions 60 include an aperture 62 therethrough for attachment and mounting to the vehicle. Strengthening ribs 64 are provided on the cross arms 54 and into the second bar 56 and the plate 60. As illustrated in FIG. 6, the first bar 52 is inclined relative to the cross arms 54 to provide clinching against the header 22. During assembly, as illustrated in FIG. 2, the second bar 56 may be deformed against the tank 24 for clinching the locking means 50 to the assembled apparatus 10. FIG. 7 illustrates the cross section at the plate 60.

The second embodiment of the locking means 50' as illustrated in FIGS. 8-9 is substantially similar to the first embodiment except that the second bar 56' is continuous along the cross arms 54', and extends for the length equivalent to the length of the first bar 52'. The gaps 57, are provided between cross arms 54'. In this embodiment, the first bar 52' may be deformed at assembly (as in the first embodiment) to provide an interference fit.

In either embodiment, the locking means 50 may continuously extend the longitudinal length of the tank units 12, or may be discontinuous providing shortened sections of locking means 50 wherein a plurality of locking means 50 may be spaced along a longitudinal side of the tank unit 12.

In operation, the tank 24 is aligned and mated with the header 22. The locking means 50 inserted over full length, or its equivalent in multiple shorter lengths, onto both sides of the aligned tank 24 and headers 22 such that the cross arms 54 engage the mating notches 32, 44 in the flanges 30, 42 of the tank 24 and header 22. The locking means 50 holds the header 22 and tank 24 in proper alignment and proximity as determined by the dimensional geometry of the bars 52, 56 and arms 54 with the notches 32, 44. Furthermore, during assembly of the locking means 50 to header 22 and tank 24, the first bar 52' and second bar 56 (depending on embodiment) can be bent slightly inward toward the tank 24, or otherwise distorted by alternate means, so as to provide an appropriate amount of interference with the engaged notches 32, 44 in order to tightly lock the apparatus 10 together thus facilitating the further processing through the bonding process. Thereafter, the core 14 is assembled to the header 22 and the apparatus 10 is braze sealed. Alternatively, the headers 22 may be first assembled to the tubes 16 and air centers 18, and thereafter assembling the tanks 24 with the locking means 50.

The advantages of the invention include the reduction in depth dimension of the apparatus 10 by decreasing the width of the tank units 12 by removal of a self contained tab and the locking means 50 being contained entirely within the periphery of the flanges 30, 42. The locking means 50 provides enhanced joint strength facilitating higher burst pressures without increasing the gauge of components The minimized joint feature additionally reduces the required raw material sizes of the components to the minimum amount. The design also provides an integral means for the attachment of required mounting brackets to the apparatus 10 by way of the extended connected bracket portions 60 wherever required, providing enlarged half areas which can contain the pierced hole 62 to accommodate the fastening of the brackets to the tabs with self tapping screws or other means.

Conventional aluminum heat exchanger materials are employed so that conventional brazing can be used. The header 22 and tank 24 may be stamped from a base material of aluminum 3003 and are clad with aluminum 4343 which serves as brazing material. Alternatively, other alloy combinations appropriate to the attended brazing process may be used. With braze cladding thus on the oppositely facing sides of the tank and header, there is provided brazing of the tank 24 and header 22 at the mating surfaces or flanges. The locking means 50 may be of a similar material braze coated on the inside. Alternatively, the locking bar 50 may be of higher strength, heat treatable alloy.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

I claim:

1. In a locking heat exchanger apparatus a pair of longitudinal tank units supporting a core therebetween, each tank unit providing a fluid chamber formed by separate headers and tanks, the core having a plurality of parallel flow tube passes extending between the tank units and including air centers therebetween each of the headers and tanks including longitudinal flanges extending longitudinally along a perimeter for providing complementing abutting surfaces along the perimeter to seal the tank unit during brazing thereof, the tanks and headers providing a tank width established between the flanges across the fluid chamber, the improvement comprising:

said longitudinal flanges of the tank and header each including spaced, aligned notches therein;

locking means extending within said aligned notches of said flanges of the tank and header for securement about said longitudinal flanges to maintain said header against said tank.

2. In a locking heat exchanger apparatus including a pair of longitudinal tank units supporting a core therebetween, each tank unit providing a fluid chamber and formed by separate headers and tanks, the core having a plurality of parallel flow tube passes extending between the tank units and including air centers therebetween each of the headers and tanks include longitudinal flanges extending longitudinally along a perimeter for providing complementing abutting surfaces along the perimeter to seal the tank unit during brazing thereof, the tanks and headers providing a tank width established between the flanges across the fluid chamber, the improvement comprising:

said longitudinal flanges of the tank and header including spaced notches therein;

locking means extending within said notches of said flanges for securement about said longitudinal flanges to maintain said header against said tank, said locking means comprising a longitudinally extending first bar abutting the header and having cross arms extending perpendicular therewith and spaced along said first bar to be received within said notches, and a second bar parallel to said first bar and perpendicular to said cross arms for abutting against the tank to maintain said header against said tank.

* * * * *